US006907956B2

(12) United States Patent
Thaller et al.

(10) Patent No.: US 6,907,956 B2
(45) Date of Patent: Jun. 21, 2005

(54) DEVICE FOR RESCUING PERSONS, OBJECTS AND THE LIKE FROM BUILDINGS

(76) Inventors: Frank Thaller, Linsenhoferweg 26, 72636 Frickenhausen (DE); Sabine Hirsch, Steetwiesen 15, 73269 Hochdorf (DE)

( * ) Notice: Subject to any disclaimer, the term of this patent is extended or adjusted under 35 U.S.C. 154(b) by 0 days.

(21) Appl. No.: 10/420,340

(22) Filed: Apr. 22, 2003

(65) Prior Publication Data

US 2004/0079585 A1 Apr. 29, 2004

(30) Foreign Application Priority Data

Apr. 25, 2002 (DE) ..... 102 18 360
Apr. 15, 2003 (DE) ..... 103 18 301

(51) Int. Cl.[7] ..... E04G 3/00
(52) U.S. Cl. ..... 182/82; 182/3; 182/9
(58) Field of Search ..... 182/82, 3, 4, 5, 182/6, 7, 8, 9, 42, 43, 44

(56) References Cited

U.S. PATENT DOCUMENTS 277,992 A * 5/1883 Chase ..... 182/192
286,456 A * 10/1883 Macdonough ..... 182/82
291,940 A * 1/1884 Robertson ..... 182/191
300,090 A * 6/1884 Larson et al. ..... 182/193
308,444 A * 11/1884 Terwilliger ..... 182/82
748,114 A 12/1903 Smith
1,055,282 A * 3/1913 Klettke ..... 182/42
1,716,268 A * 6/1929 Gosciewski ..... 182/82
3,874,632 A * 4/1975 Rago ..... 182/3
4,003,550 A * 1/1977 Brodin ..... 182/42
4,466,507 A * 8/1984 Itano ..... 182/3
5,029,669 A * 7/1991 Lew et al. ..... 182/42

FOREIGN PATENT DOCUMENTS

DE 82 36 927 5/1983
DE 38 40 057 6/1988
GB 2064455 * 6/1981 ..... 182/82 X

* cited by examiner

*Primary Examiner*—Bruce A. Lev
(74) *Attorney, Agent, or Firm*—Gudrun E. Huckett

(57) ABSTRACT

A device for rescuing persons and objects from buildings has at least one rescue element that is a rescue rope to be anchored to the ground. A retaining element of a rescue belt can be attached to the rescue rope. The rescue rope is wound onto a winding device in an initial state and unwound for a rescue operation. A deflection unit is attached to the rescue rope and has an axle. At least one driving gear is fixedly attached to the axle of the deflection unit for common rotation, and the rescue rope is redirected by 180° by the deflection unit.

24 Claims, 11 Drawing Sheets

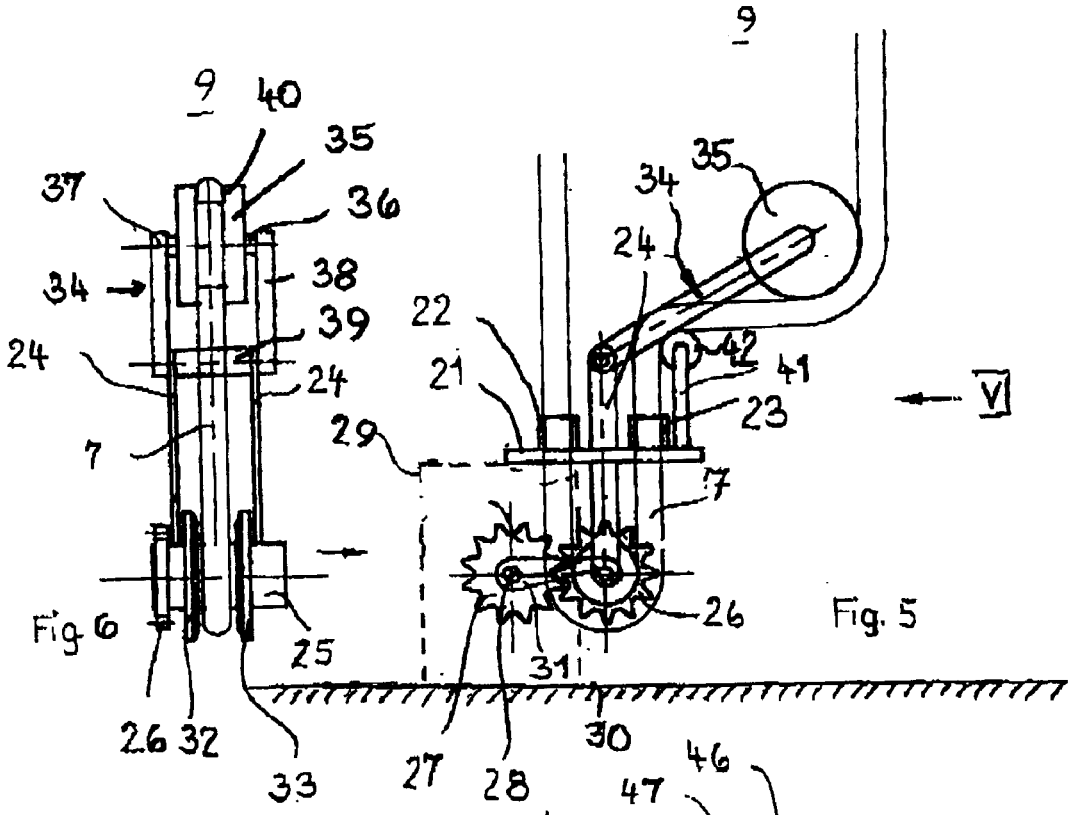
Fig. 6
Fig. 5
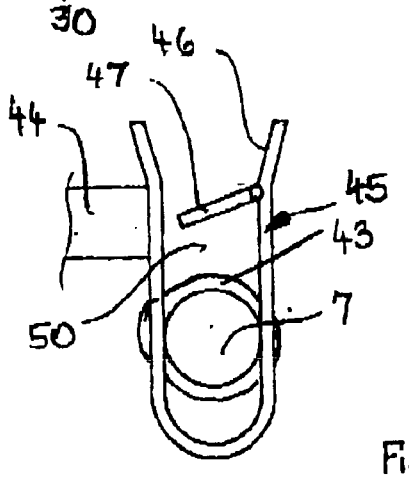
Fig. 8
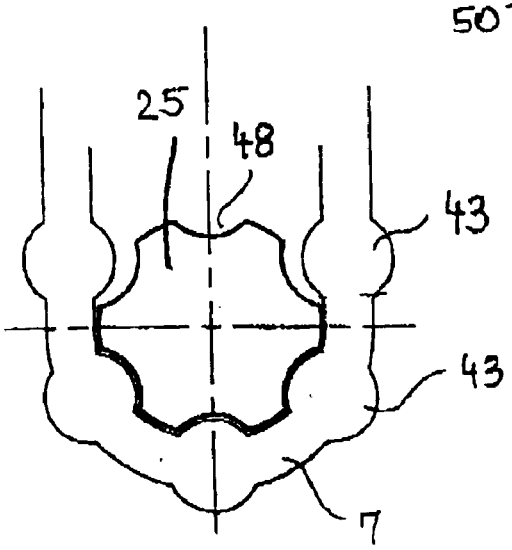
Fig. 7

DEVICE FOR RESCUING PERSONS, OBJECTS AND THE LIKE FROM BUILDINGS

BACKGROUND OF THE INVENTION

The invention concerns a device to rescue people, objects and the like from buildings comprising at least one rescue element pursuant.

For rescuing people from buildings, inflatable chutes are known as rescue elements, on which people can be rescued from a building e.g. in case of a fire. Such inflatable chutes are however unsafe as of the second floor. Jumping sheets are also known as rescue elements, which are however unsafe as of the third floor. For rescuing people from major heights turntable ladders are known, which normally have a climbing height of 30 m and reach maximum overall heights of 52 m. The evacuation of especially elderly, wounded, unconscious or shocked people from buildings by such ladders can only occur individually and is therefore time consuming. Since the ladders sway at the top more or less depending on the wind force, the rescuing is also dangerous.

To rescue several people simultaneously, hinge platforms were developed, which however need a lot of space to deviate, and this space is not always provided. Fire escape stairs on the exteriors of buildings are only available on low buildings.

SUMMARY OF THE INVENTION

The object of the invention is to form the device according to this category in such a manner that a major amount of people, objects or the like can be evacuated from the risk zone within the shortest period of time in case of an emergency.

This task will be solved by the device according to this category in compliance with this invention in that the rescue element is a rescue rope, to which a retaining element of a rescue device can be attached and which can be anchored on the ground.

By the device in compliance with this invention a rescue rope is used as a rescue element, which can be let down from the roof of a building and anchored on the ground. The people who shall be rescued can hook into the rescue rope, which runs over the top of the building, with the retaining element of their rescue device, especially a rescue belt. This way, people can be evacuated from the building with the rescue rope within the shortest period of time. The term "rescue rope" may mean ropes but also e.g. chains.

Advantageously, the rescue device is placed on the roof of the building. In case of an emergency, an alarm can be activated by hand or automatically, so that the rescue device is actuated. In this case, the rescue rope is let down to the ground and anchored there. The rescue rope can be moved towards the ground due to its self-weight. The rescue rope is advantageously formed to circulate unendingly. In this case a deflection unit is advantageously attached to the rescue rope, which can be lowered to the ground and anchored there. This can be done by the firemen or other rescuers. It is however also possible to anchor this deflection unit firmly to the ground and connect it with the rescue rope for a rescue operation. If the rescue rope is formed to circulate unendingly it will be rotary driven. For this, a power equipment can be positioned on the ground, with which the rescue rope, which is let down to the ground, is rotary driven. The people, who are hooked into the rescue rope, are rescued reliably and within the shortest period of time this way. The forwarding velocity can be controlled by mechanical, fluidic or electrical brakes. The circulation velocity of the rescue rope is chosen in such a manner that the people who are to be rescued can be let down to the ground reliably without any risk for injuries.

The device in compliance with this invention is splendidly applicable for skyscrapers, but can naturally also be used for lower buildings such as apartment houses, towers and the like. With this rescue device preferably people are rescued, however also objects can be transported to the ground with the rescue rope.

Further characteristics of the invention arise from the further claims, the description and the drawings.

BRIEF DESCRIPTION OF THE DRAWINGS

The invention is specified by the illustrated embodiments presented in the drawings. They show.

DESCRIPTION OF PREFERRED EMBODIMENTS

Figure 1:
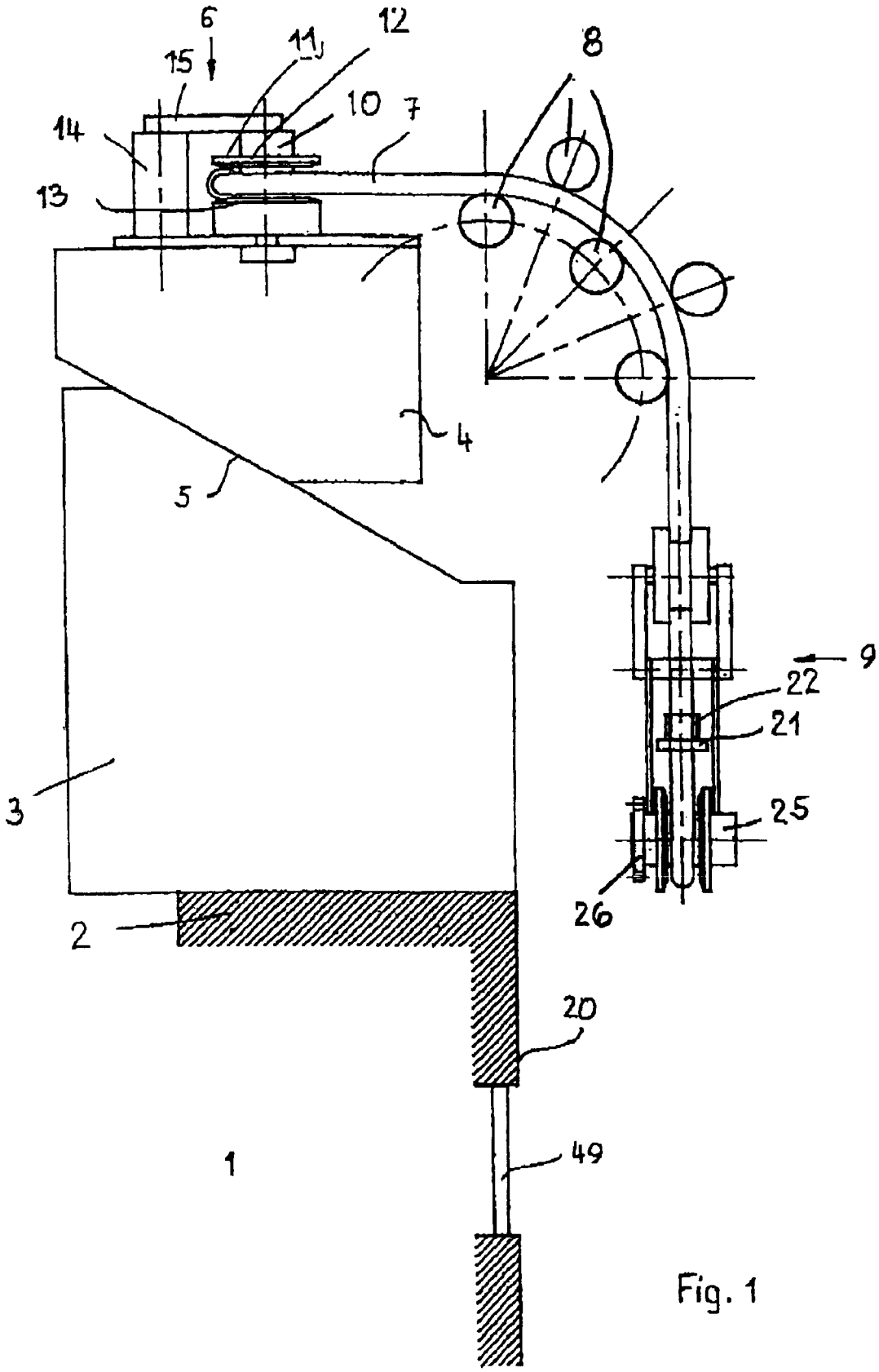
FIG. 1 in schematic illustration a rescue device in compliance with the invention in drawn-in position of rest, FIG. 2 the rescue device according to FIG. 1 in reeled-out operating position, FIG. 3 a flexible rescue rope of the rescue device in compliance with the invention, FIG. 4 different phases of winding up the rescue rope according to FIG. 3 on a winding drum, FIG. 5 lateral view of a deflection unit of the rescue device in compliance with the invention, FIG. 6 a view in the direction of the arrow VI in FIG. 5, FIG. 7 a deflection pulley for the flexible traction element, FIG. 8 a rescue belt to hook into the flexible rescue rope of the rescue device, FIG. 9 in an illustration according to FIG. 1 a second embodiment of a rescue device in compliance with the invention, FIG. 10 in longitudinal section an upper part of a facade of a building, FIG. 11 a section along the line XI—XI in FIG. 10, FIG. 12 a third embodiment of a rescue device in compliance with the invention in initial position, FIG. 13 rescue device according to FIG. 12 in a partly lowered position, FIG. 14 in schematic illustration and in lateral view a further embodiment of a rescue device in compliance with the invention, FIG. 15 illustration in larger scale and in section of a person who is to be rescued, and who is hooked into the rescue device, FIG. 16 a section along the line XVI—XVI in FIG. 15, FIG. 17 a longitudinal section through the wall of a building, in which a part of the rescue device is placed, FIG. 18 partly in view and partly in section the in FIG. 17 illustrated area of the rescue device, FIG. 19 in schematic illustration a discharging area at the lower end of the rescue device.

The rescue device serves to rescue people quickly and reliably in case of an emergency. e.g. at a fire in a building. The building 1 has a roof 2, on which the rescue device is placed. It has a carrier 3, which is mounted on the roof 2 and on which a drive unit 4 to wind up the rescue rope 7 is supported. It can be displaced from the rest position illustrated in FIG. 1 to the operating position illustrated in FIG. 2 on the carrier 3. It has advantageously a guide way 5 which runs inclined downwards, along which the drive unit 4 can be relocated. In the drive unit 4 a drive (not illustrated) is designated, with which the drive unit 4 can be moved along the guide way 5 in the respective direction. The carrier 3 can have racks, in which the drive unit 4 engages with corresponding gears. Naturally, other drives are also possible in order to move the drive unit 4 along the guide way 5. Since the drive unit 4 runs inclined, the own weight of the drive unit 4 can be used for moving. Thereby, the drive unit 4 can be loaded through a spring device, so that it moves downwards along the guide way 5 after release.

Differing from the illustrated embodiment the guide way 5 can also run horizontally. In this case a drive is necessary to operate the drive unit 4.

On the drive unit 4 there is a winding device 6 for the rescue rope 7. The winding device 6 will be driven in a way yet to describe in order to wind up or unwind the rescue rope. It is favourable if the rescue rope 7 is unwound because of its self-weight. Then there is no need for the winding device 6 to have an own drive in order to unwind the rescue rope. For the rescue rope 7 guide pulleys 8 are provided, between which the rescue rope 7 runs and which redirect the rescue rope at an angle of 90° downwards. The guide pulleys 8 are connected with the drive unit 4. The guide pulleys 8 can be connected with the drive unit 4 in the known manner.

On the free end of the rescue rope 7 a deflection unit 9 is provided, with which the rescue rope 7 is redirected at the end, which is turned away from the winding device 6. The rescue rope 7 is formed unendingly and will be redirected at the deflection unit 9 as well as at the winding device 6.

The winding device 6 has a vertical driving shaft 10, which surmounts above the drive unit 4 and is circulating with a (not illustrated) drive, which is positioned in the drive unit 4. On the driving shaft 10 a guide 11 for the rescue rope 7 is fixedly attached. The guide 11 consists of two plates 12, 13 which are positioned with distance opposite of each other, and between which the rescue rope 7 runs.

With distance to the driving shaft 10 the drive unit 4 is provided with an axle 14, which runs parallel to the driving shaft 10 and is connected with the driving shaft 10 at the upper end by a cross bar 15. If the driving shaft 10 is turned around its axis, the axle 14 is picked up by the cross bar so that it circulates around the driving shaft 10.

Figure 4:
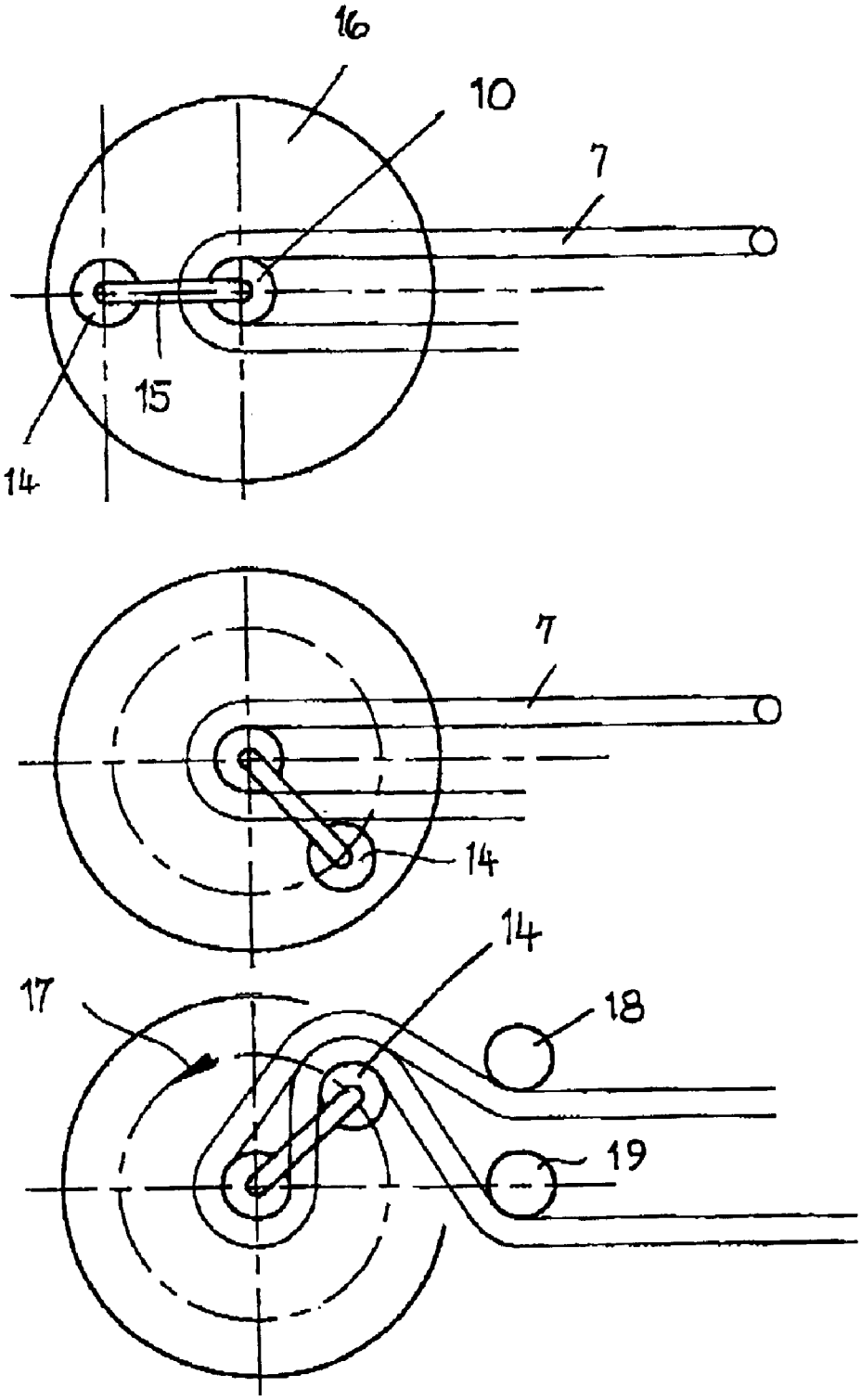

As FIG. 4 shows, the rescue rope 7 is redirected by 180° at the driving shaft 10. If the driving shaft 10 is redirected counterclockwise in arrow direction 17, the axle 14 goes around the axis of the driving shaft 10 in the circulating direction 17, until it hits the rescue rope 7 (middle illustration in FIG. 4). When the circulation continues, the axle 14 picks up the two strands of the rescue rope 7, which thereby is wound up. Advantageously, the two strands of the rescue rope 7 are guided through two vertical guide pulleys 18, 19 with distance from a base plate 16 of the winding device 16, so that the rescue rope 7 can be reliably wound up on the winding device 6.

It is possible not to drive the driving shaft 10 directly, but to drive the circular base plate 16. In this case the driving shaft 10 and the axle 14 are fixed on the base plate 16 and are picked up by it when it is circulating around its axis.

Figure 2:
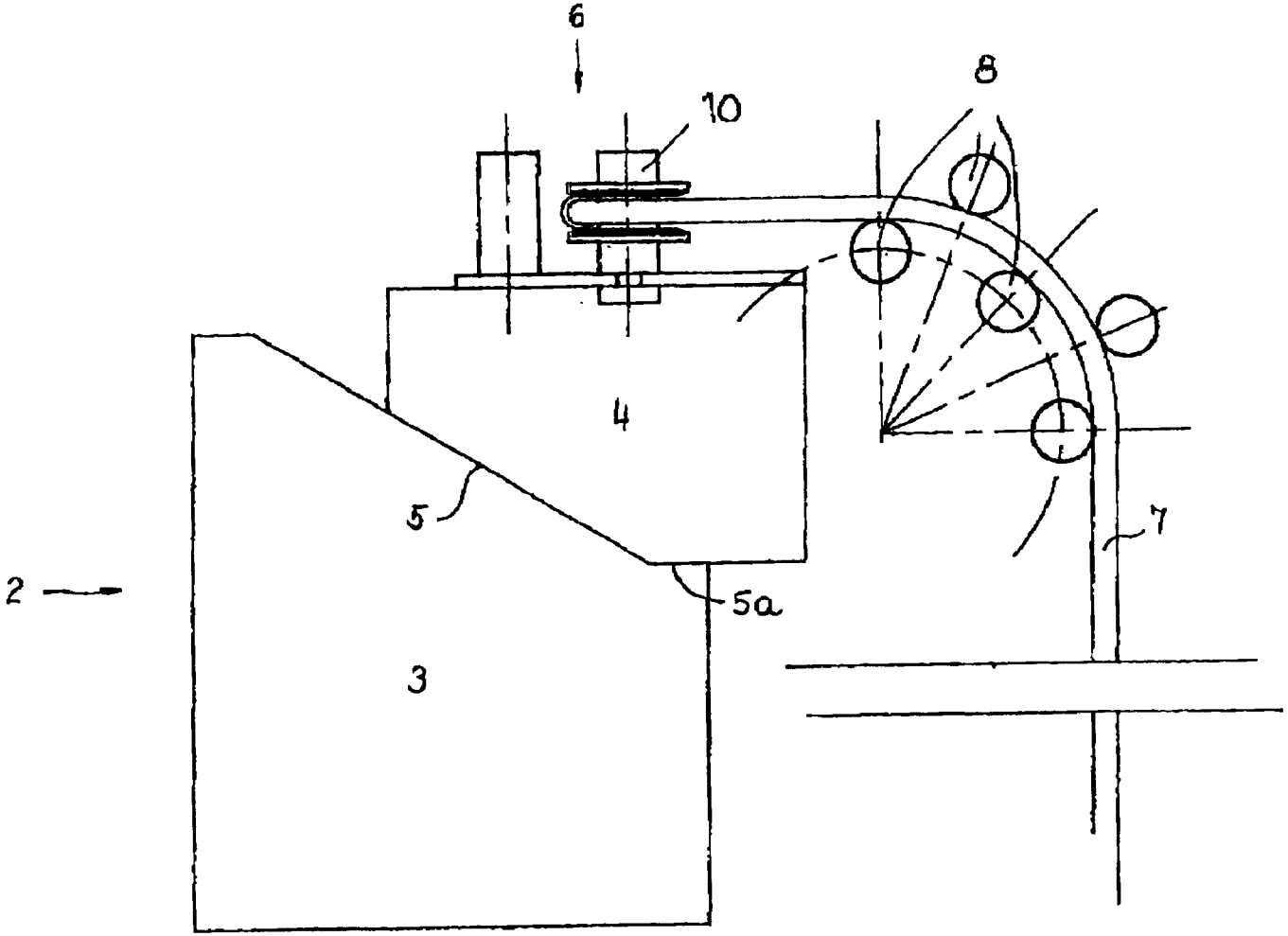

In the starting position the drive unit 4 is withdrawn to its initial position illustrated in FIG. 1. The rescue rope 7 is completely wound up on the winding device 6. Only the deflection unit 9 is positioned in the area in front of the facade 20 of the building 1.

The deflection unit 9 (FIGS. 5 and 6) has a support plate 21 through which the two strands of the rescue rope 7 surmount. In the passage area of the rescue rope 7, sleeves 22, 23 stick out from the upper side of the support plate 21, through which the two strands of the rescue rope 7 run and whose inner diameter corresponds to the outer diameter of the rescue rope 7.

In the area between the two sleeves 22, 23, two arms 24 surmount through the support plate 21, which carry a horizontal axle 25 at their lower end. The rescue rope 7 is redirected by 180° at the axle 25.

On the axle 25 a gear 26 is fixedly attached, which can be engaged with a gear 27. The gear 27 is positioned on a driving shaft 28 of a power equipment 29, which is positioned on the ground 30.

Since the deflection unit 9 is held only by the rescue rope 7, a clutch 31 is provided to properly transfer the torque from the power equipment 29 to the gear 26. The clutch 31 is formed for example by at least one pivot arm, whose one end is mounted turnable on the driving shaft 28, and whose free end is attached to the axle 25. This way the two gears 26, 27 are reliably kept engaged. Thereby an oscillation of the deflection unit 9 is prevented.

As FIG. 6 shows, the gear 26 is positioned directly beside one of the arms 24. On the axle 25 two plates 32, 33 are fixedly attached in the area between the two arms 24, between which the rescue rope 7 is properly positioned at its direction change.

At the upper end of the two parallel positioned and equally formed arms 24 a u-bolt 24 is pivoted, which carries a tension pulley 35 for the rescue rope 7. It is positioned free pivoted on an axle 36, whose ends are connected to the free ends of the parallel shanks 37, 38 of the u-bolt 34. The u-bolt 34 is pivoted by a cross bar 39 connecting the shanks 37, 38 at the free ends of the arms 24 with a catch or (spring-) force tension. The tension pulley 35 is positioned freely rotatable on the axle 36 and is provided with a circumferential groove 40, through which the rescue rope 7 runs.

On the support plate 21 a carrier 41 is fixed upwardly, which carries a free pivoted deflection pulley 42 for the rescue rope 7 at its free end.

As FIG. 5 shows, one of the strands of the rescue rope 7 is deflected by up to 90° at the tension pulley 35 towards the deflection pulley 42. At the deflection pulley 42 the strands is deflected by 90° downwards in the sleeve 23. At the axle 25, which is distant positioned underneath the support plate 21, the rescue rope 7 is redirected by 180° upwards in a way that it runs upwards through the sleeve 22 towards the winding device 6.

Since the rescue rope 7 is formed to circulate unendingly, people can be rescued with it in the operating position of the rescue device from building 1 in a way yet to be described, whereas the number of people who are to be rescued is not limited to the length of the rescue rope 7.

To keep enough tension of the rescue rope 7, the u-bolt 34 is advantageously burdened towards the tension position. It is also possible to fix the u-bolt 34 rigidly on the upper ends of the arms 24, so that the u-bolt 34 can not pivot towards the arms 24. In this case an adjustment of the tension force is not possible.

The length of the rescue rope 7 is chosen in a way that, in a completely unwound condition, it ranges from the winding device 6 so far towards the ground 30, that the deflection unit 9 can be connected with the power equipment 29 in the described manner.

The rescue rope 7 consists of a fireproof and fail-safe material such as high-temperature steel and the like. The heat resistance of the rescue rope 7 is advantageous, when people are to be rescued from a building 1 on fire. It is then guaranteed that the rescue rope 7 can fulfil its function reliably. The rescue rope 7 is so flexible formed that it can be redirected on the different pulleys 8, 25, 42 35 and be wound up on the winding device 6. It can also be formed as a chain.

Figure 3:
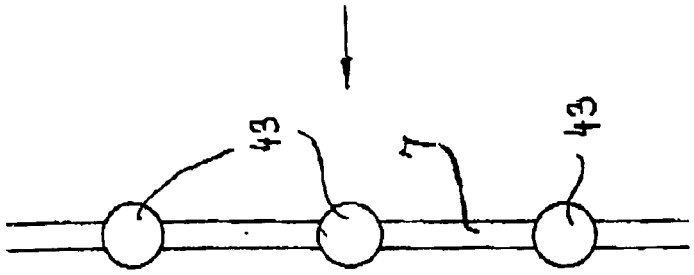

As FIG. 3 shows, the rescue rope 7 is provided with enlargements 43 throughout its length, advantageously in equal distance from each other. They are rigidly connected with the rescue rope 7 and serve as slipping protection for the people who are hooked into the rescue rope 7.

The people who are to be rescued from the building 1 are provided with a safety belt 44 (FIG. 8), which is kept easily accessible for the people in the building 1 in case of an emergency. The rescue belt 44 is provided with a snap-hook 45, which can be hooked into the rescue rope 7 in the area between two enlargements 43. The snap-hook 45 has an extended insertion ending 46 so that the snap-hook 45 can be hooked into the rescue rope quickly and reliably also in case of an emergency. The safety catch 47 prevents that the snap-hook 45 is unintentionally loosened from the rescue rope 7 during a rescue operation.

The axle 25 is, as FIG. 7 shows, provided with partly circular recesses 48 on the circumference in the area, in which it is entwined by the rescue rope 7. The recesses 48 are adapted to the circumference form of the enlargements 43 of the rescue rope 7. The rescue rope 7 thereby engages with the recesses 48 of the axle 25 when it is deflected at the axle 25. This form fit between the axle 25 and the rescue rope 7 ensures that the rescue rope 7 is properly rotary driven. The other pulleys and shafts, through which the rescue rope 7 is guided, are also provided with corresponding intakes for the enlargements 43.

If an emergency occurs in building 1, e.g. a fire, the rescue device is advantageously put into operation automatically. Naturally, it is also possible to switch on the rescue device by hand. First of all the drive unit 4 runs out of its starting position according to FIG. 1 along the guide way 5 into the operating position according to FIG. 2. Since the guide way 5 runs inclined in the embodiment, it changes over to a horizontal section 5*a* at its lower end. Thereby is achieved that the drive unit 4 in the operating position is reliably supported on the carrier 3 according to FIG. 2. The drive unit 4 surmounts above the exterior of the building 1 in the operating position according to FIG. 2, so that the rescue rope 7 can be reliably unwound. Advantageously, the driving shaft 10 is circulating in the winding-off direction by itself when the drive unit 4 has reached its operating position according to FIG. 2. However, it is also possible to switch on the driving shaft 10 separately. The guide pulleys 8, which are positioned along a circular arc, and between which the rescue rope 7 is led, ensure that the rescue rope 7 is distant enough from the facade 20 of the building 1, when it is let down from the roof 2 of the building. Since the rescue rope 7 carries the deflection unit 9, the rescue rope 7 can be unwound reliably. As soon as the deflection unit 9 is let down to the ground 30, it is connected to the power equipment 29 placed there. From now on the rescue rope 7 can be driven by the drive unit 4 as well as by the power equipment 29. The two drives are synchronized with each other so that the rescue rope is properly circulated. However, it is also possible to only unwind the rescue rope 7 initially with the drive unit 4 and to circulate it then. The power equipment 29 is at disposal as a substitution drive, in case the drive for the driving shaft 10 in the driving unit 4 should fail. It is also possible to operate the drive through the power equipment 29 alone. The power for the power equipment 29 can be supplied by an emergency backup generator, as they are at disposal in e.g. fire trucks. The rescue rope 7 is positioned with such a distance to the building facade 20 that people at risk in building 1 can comfortably reach the rescue rope 7 and can, after having put on the rescue belt 44, hook into the rescue rope 7 with the snap-hook 45. Thanks to the enlargements 43 in the rescue rope 7, which are broader than the lead-through opening 50 (FIG. 8) of the snap-hook 45, it is ensured that the person hooked into the rescue rope 7 does not slip downwards along the rescue rope 7, but remains between the enlargements 43 of the rescue rope 7. Since the rescue rope is formed to circulate unendingly, the person who is to be rescued is reliably transported downwards. The endless circulation of the rescue rope 7 has above all the advantage that the people who are to be rescued can be hooked into the rescue rope 7 in the described manner. Thereby, a major amount of people can be reliably rescued from the building 1 within the shortest period of time. The people can reach the rescue rope 7 from each floor through the respective window and hook into it.

Thanks to the enlargements 43 it is prevented that the people hanging in the rescue rope 7 interfere with each other. The distance between the enlargements 43 is only so big that the persons who are to be rescued can hook the snap-hook 43 easily and quickly into the rescue rope 7. Due to the respectively small distance between the enlargements 43 it is guaranteed that the persons who are to be rescued can hook into the rescue rope 7 at almost any spot, so that they can be rescued from the building through the rescue rope 7 within the shortest period of time.

Naturally, it is also possible to have several rescue devices positioned on the roof 2 of the building 1, so that enough rescue devices and corresponding rescue ropes 7 are at disposal to rescue a major amount of people from the building 1 within the shortest period of time in case of an emergency. The rescue devices are positioned in such a manner that the people who are to be rescued can reach the rescue ropes 7 through the windows 49 of the building.

Figure 9:
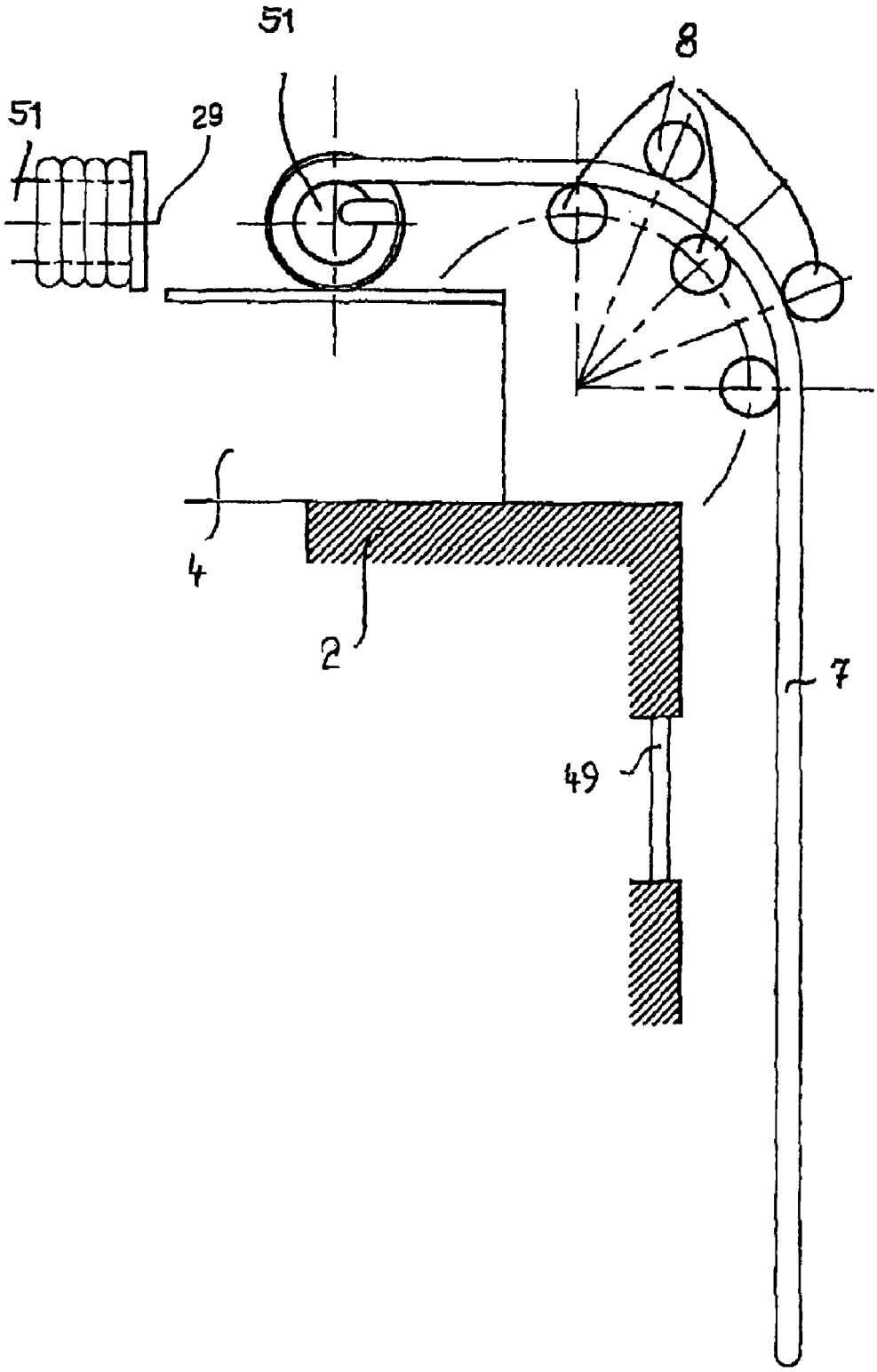

FIG. 9 shows an embodiment in which the drive unit 4 is stationary positioned on the roof 2 of the building. The guide pulleys 8 are connected with the drive unit 4 in such a manner that the rescue ropes 7 run in front of the windows 49 of the building with such distance that the people who are to be rescued can easily hook into the rescue rope 7 with the snap-hook 45 of their rescue belt 44. In contrast to the previous embodiment the rescue rope 7 is wound up on a horizontal drum 51, which can be rotary driven. In contrast to the previous embodiment the rescue rope 7 is not formed to circulate unendingly. During use, the rescue rope 7 is rather unwound so far away from the drum 51 that it ranges to the ground. At the lower end of the rescue rope 7 a weight can be fixed so that the rescue rope 7 can be unwound reliably.

In contrast to the previous embodiment the rescue rope 7 has not got any enlargements. Instead, the rescue belt 44 is provided with a (not illustrated) hook, with which the person who is to be rescued can hook into the rescue rope 7 in such a manner that the hook does not slip down along the rescue rope 7. Such hooks are known e.g. for mountain climbing and are therefore not specified. These hooks have a rope brake which can be operated by the person who is to be rescued in order to slip downwards along the rescue rope 7 with a lower or also higher speed.

Figure 10:
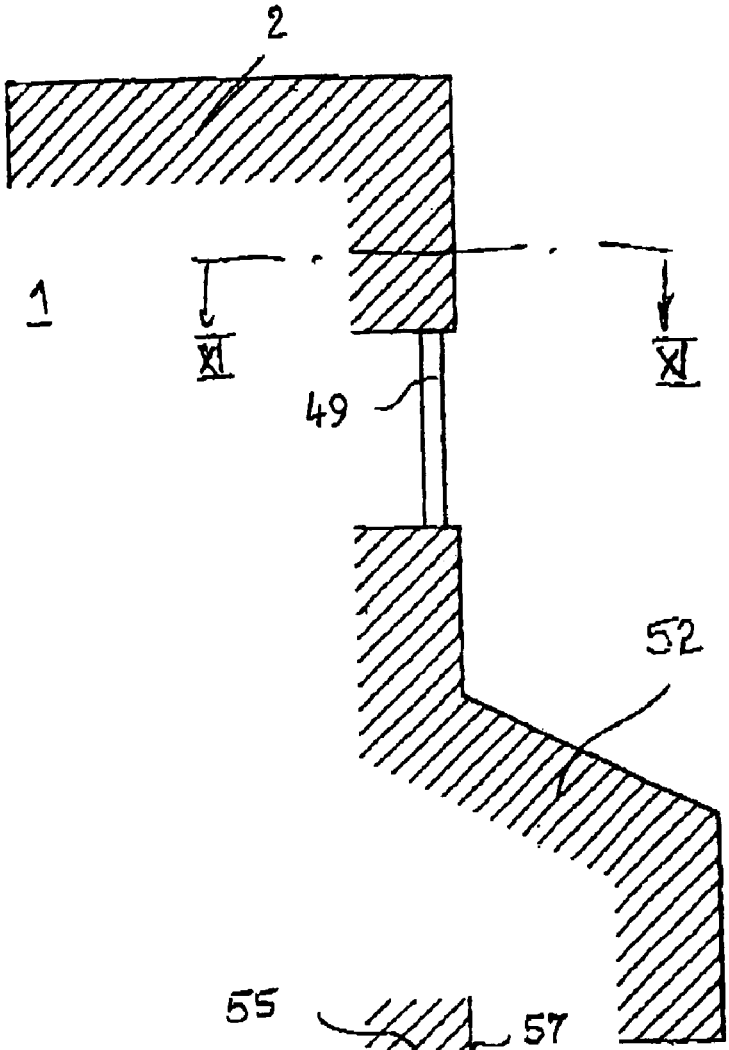
Figure 11:
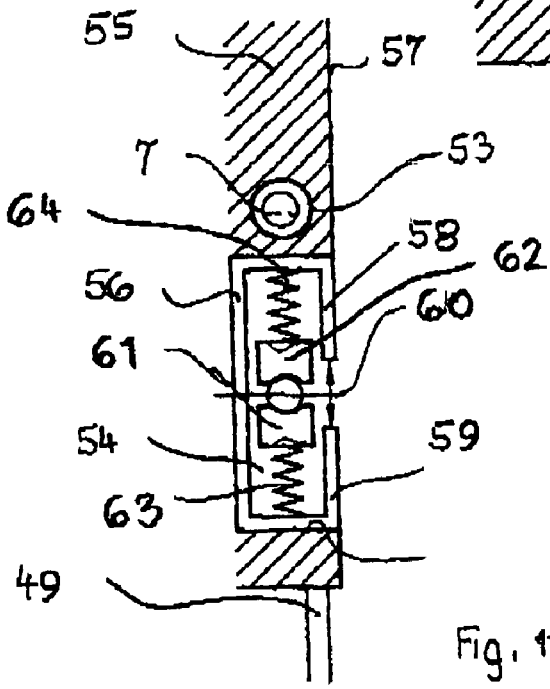

The FIGS. 10 and 11 show the possibility to use the rescue device also for such buildings, which have a front building 52 in the front window area. To be able to unwind the rescue rope 7 downwards from the roof 2 of the building 1 also in this case, the two strands of the rescue rope 7 are guided in channels 53, 54, which are placed directly beside the windows 49 in the wall 55 of the building. The channel 53 has a circular transverse section and can be formed through a pipe integrated in the wall 55 of the building. The other channel 54 is limited by a c-profile 56, which is integrated in the wall 55 of the building and surmounts the top of the building 1. The c-profile is positioned close to the window 49 and has got shanks 58, 59 in the exterior 57 of the wall 55 of the building, which are positioned aligned with each other, and between whose ends an inlet opening 60 limits, behind which the strands of the rescue rope 7 running downwards is situated. Above this inlet opening 60 the rescue belt 64 can be hooked into the rescue rope 7.

In channel 54 there are positioning elements 61, 62, which fit to the rescue rope 7 with the force of at least one pressure spring 63, 64. Advantageously, several such positioning elements 61, 62 are provided throughout the height of the strands of the rescue rope 7 running downwards. It is possible to form this positioning device so that the contact pressure of the positioning elements 61, 62 can be adjusted. The power equipment 29 applies a braking force so that the rescue rope 7 does not move downwards too quickly. Thus, it is ensured that the rescue rope 7 is not displaced downwards too quickly in case of an emergency.

The inlet opening 60 is provided so close to the window 49 that the people who are to be rescued can comfortably hook the span-hook 45 of their rescue belt 44 into the strands running downwards of the rescue rope 7.

Figure 12:
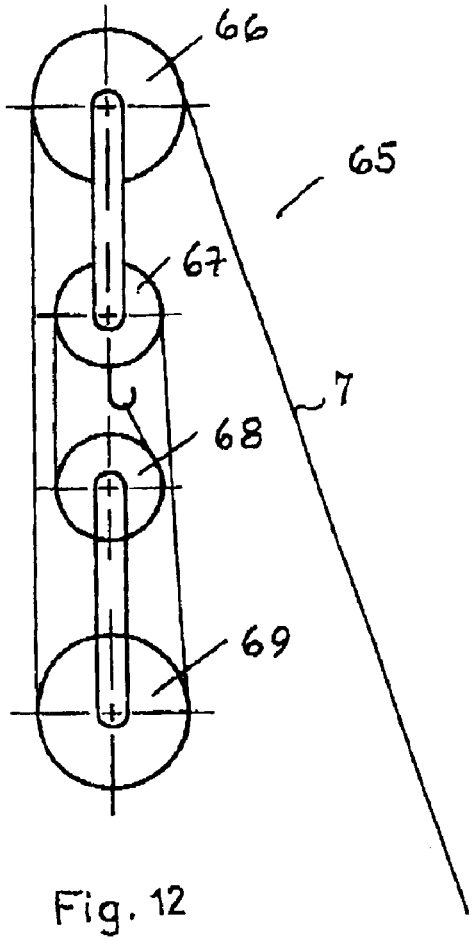
Figure 13:
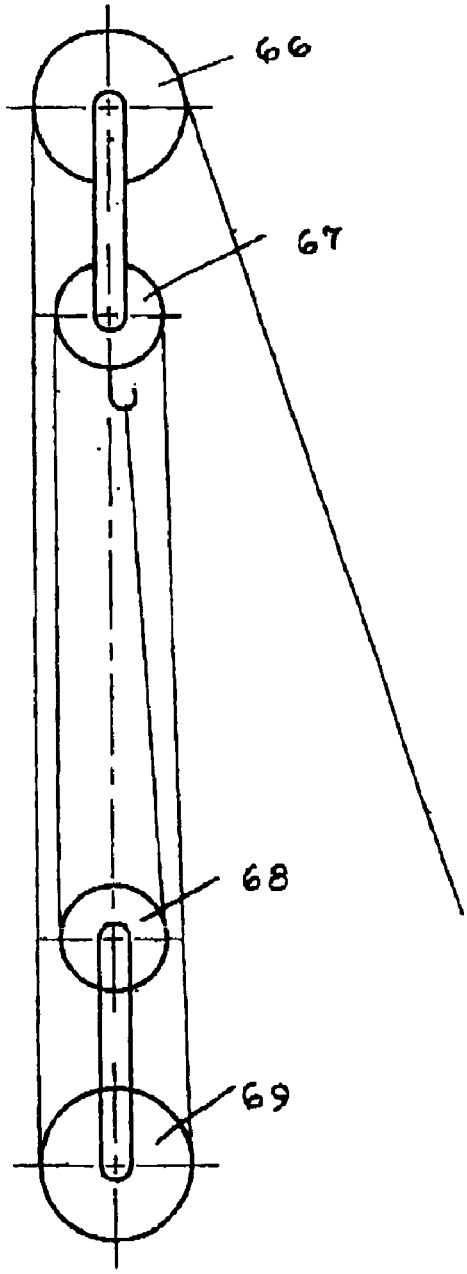

FIGS. 12 and 13 show the possibility to design the rescue rope 7 as part of a block and tackle 65, with which people who are hooked into the rescue rope 7 can be rescued from buildings with little effort. In the embodiment the block and tackle 65 has got two fixed pulleys 66, 67 as well as two loose pulleys 68 and 69. Naturally, the block and tackle can also have another form. Such a form is appropriate for lower buildings.

FIGS. 14 to 19 show a rescue device whose rescue rope 7 is formed to circulate unendingly and is positioned on a level vertical to the exterior 80 of the wall 55 of the building. In the upper area of the building the rescue rope 7 is guided over a sheave 70, which is provided with recesses 71 at the circumference. They are uniformly distributed throughout the circumference of the sheave 70 and adapted to the contour form of the enlargements 43 of the rescue rope 7. When the rescue rope 7 is circulated, the enlargements 43 attain the recesses 71 so that the rescue rope 7 is reliably picked up at the upper deflection area of the sheave 70. To prevent the enlargements 43 to fall out of the recesses 71 of the sheave 70 in the deflection area, the sheave is surrounded by a cover 72 at its upper half, whose distance from the sheave 70 is so big that the enlargements 43 can not be loosened from the recesses 71.

Figure 15:
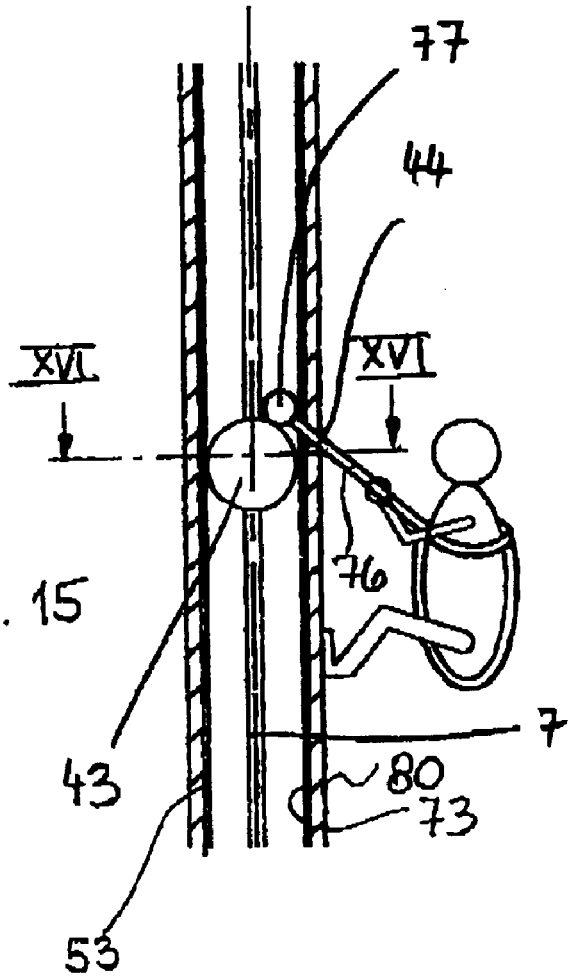
Figure 16:
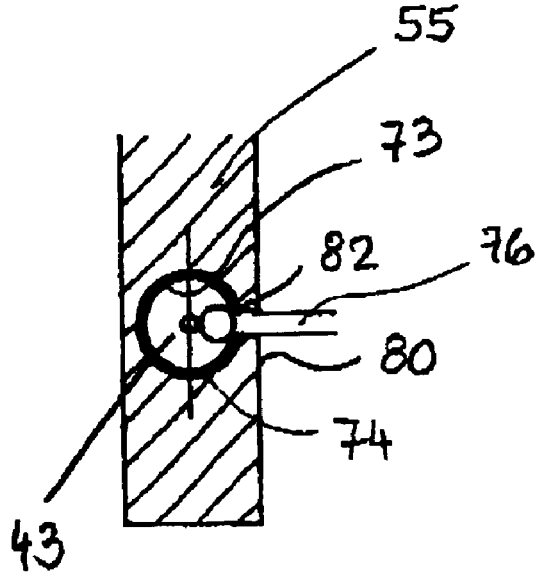
Figure 17:
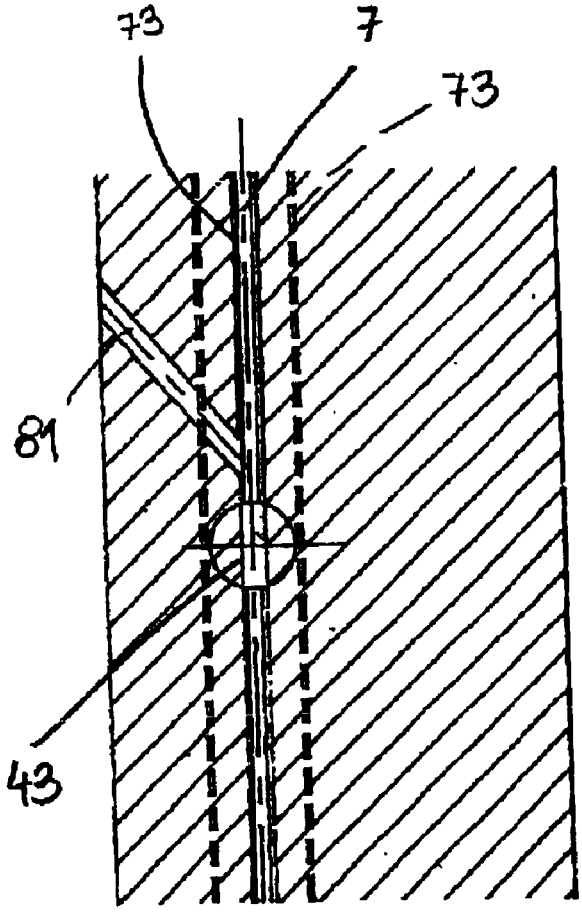
Figure 18:
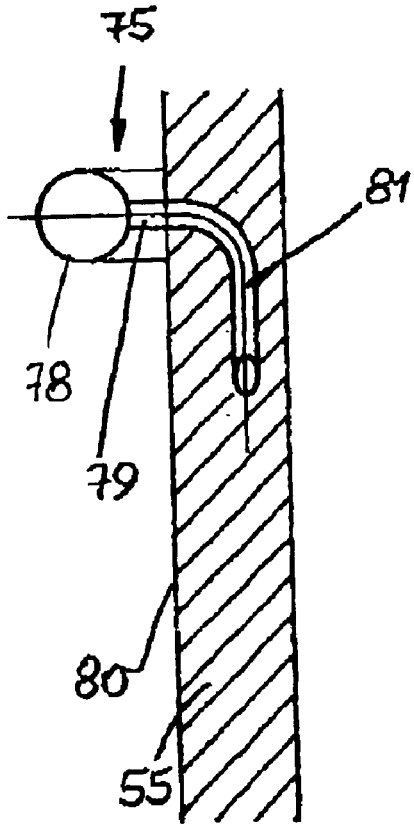
Figure 19:
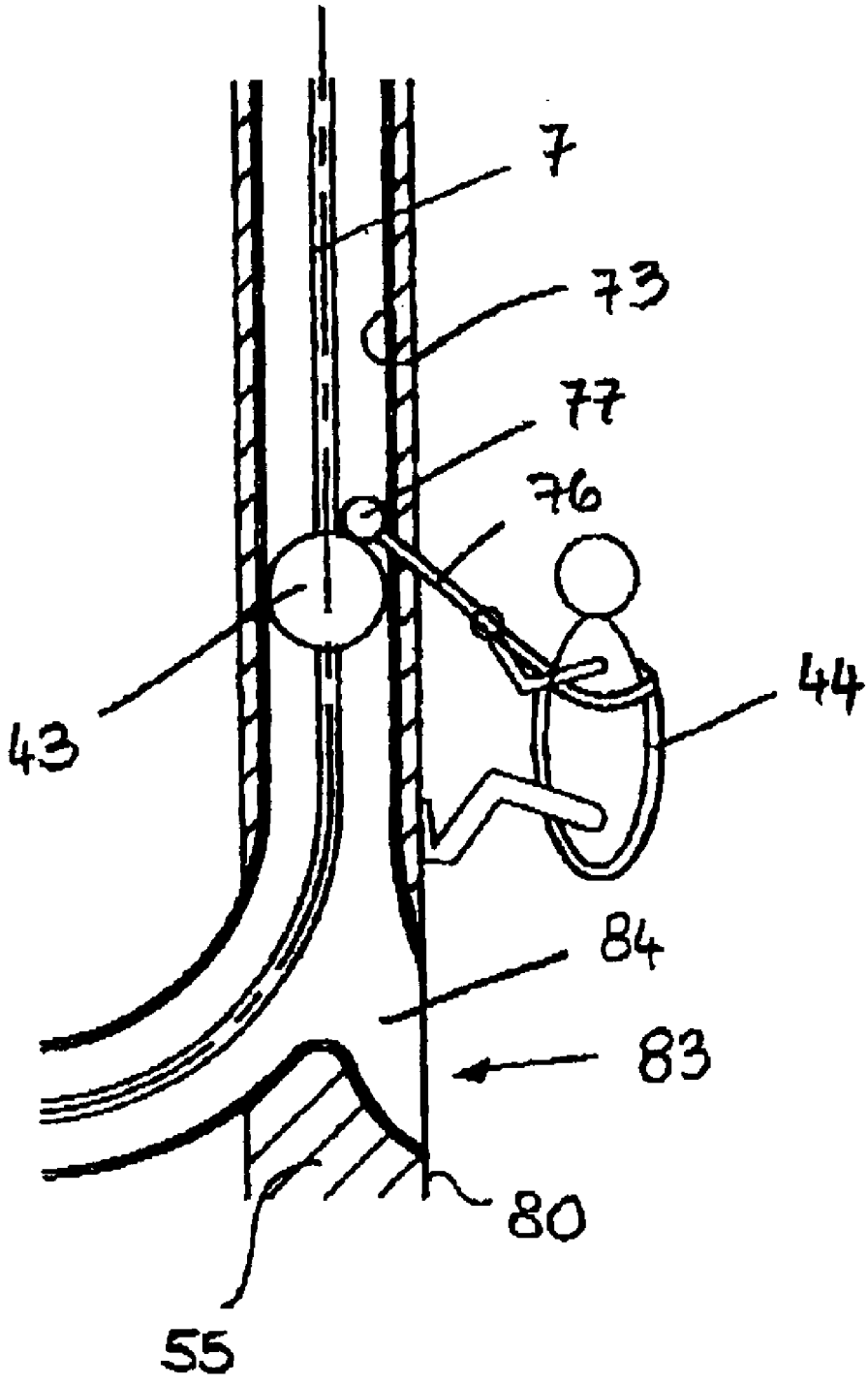

In the area of the sheave 70 the rescue rope 7 is positioned in a guide 73, which runs within the wall 55 of the building. The guide 73 is advantageously formed through a pipe, which is integrated in the wall 55 of the building. The guide 73 has an inner diameter, which corresponds to the outer diameter of the somewhat ball-shaped formed enlargement 43 (FIGS. 15 and 16). Consequently, the enlargements 43 do not only serve to fix the position of the hooked-in people who are to be rescued, but also to guide the rescue rope 7 at its circulation. The interior of the guide 73 and/or the enlargement 43 consist of a low-frictional material so that the circulation of the rescue rope 7 is reliably guaranteed.

Instead of using pipes to form the guide 73, it is for example also possible to provide the inner wall 74 of the channel 53 in the wall 55 of the building with a corresponding low-frictional coating.

To enable the people who are to be rescued to hook into the rescue rope 7 with their rescue belt 44 (FIG. 15), an inlet port 75 (FIG. 18) is provided in the area of each window of the building close to which the rescue rope 7 runs. The person who is to be rescued can therefore hook into the inlet port 75 inside the room after having put on the rescue belt 44. The rescue belt 44 is for this reason designed with a stiff belt part 76, on which free ends a retaining element 77 is positioned, which is ball-shaped formed in the embodiment. If the person who is to be rescued is, as for example illustrated in FIG. 15, hooked into the rescue rope 7, the retaining element 77 bears on the enlargement 43 of the rescue rope 7 under the weight pressure of the person who is to be rescued. Since the diameter of the enlargement 43 corresponds to the inner diameter of the guide 73 it is prevented that the retaining element 77 can slip through downwards between the enlargement 43 and the inner wall of the guide 73. Therefore, the person is hanging safely in the rescue rope 7 throughout the rescue operation. Though the belt part 76 is dimensionally stable, it can be bent elastically so that the retaining element 77 can simply be merged in via the inlet port 75 in a way yet to be described. Naturally, the belt part 76 can also be flexible formed, for example with a webbing part or the like.

The inlet area 75 (FIGS. 17 and 18) has an inlet channel 78, which is positioned inside of the room of the building and for example runs horizontally. In the room the people who are to be rescued can simply merge into the inlet channel 78 with their belt part 76. It is open at its free end and provided with a slot 79 throughout its length, whose width is smaller than the diameter of the retaining element 77. The rescue belt 44 is merged into the inlet channel 78 in such a manner that the retaining element 77 is positioned within the inlet channel 78 and the belt part 76, which shall be connected to the retaining element 77, surmounts outwards through the slot 79. As soon as the person who is to be rescued has merged her rescue belt 44, she is protected from detaching. The inlet channel 78 runs out of the room outwards through the window opening. The inlet channel 78 is bent off at the area close to the window opening in such a way that it connects to the exterior 80 of the wall 55 of the building. In the connection area of the inlet channel 78 a merging channel 81 running inclined downwards ends, which is positioned in the wall 55 of the building and leads to the vertical guide 73. To enable the belt part 76 to always reach to the outside, the merging channel 81 as well as the guide 73 is provided with a continuous slot 82 along its respective length, which ranges to the exterior 80 of the wall 55 of the building and whose width is smaller than the diameter of the retaining element 77. In the merging channel 81 running inclined downwards, the retaining element 77 slips into the guide 73 effortlessly.

Since the rescue device can be accessed inside the room of the building, the merging procedure can be effortlessly implemented by the people who are to be rescued also in case of an emergency. Since they are safely connected with the inlet channel 78 after the merging procedure, there is no risk that the person who is to be rescued can be unintentionally released from the merging channel 81.

As FIG. 15 schematic shows the person who is to be rescued can rest with the legs on the exterior 80 of the wall 55 of the building throughout the rescue operation.

As soon as the person who is to be rescued gets to a discharging area 83 (FIG. 19), the rescue belt 44 of this person is released automatically. The discharging area 83 is placed in the area of the lower direction change of the rescue rope 7. In this area the direction change of the rescue rope takes place because the guide 73 has got a corresponding course. The discharging area 83 has a discharging channel 84, which runs inclined downwards and ranges until the exterior 80 of the wall 55 of the building, and which has got such a transverse section that the retaining element 77 and the belt part 76 can slop to the outside. The transverse section of the discharging channel 84 is very small compared to the enlargement 43, so there is no risk for the enlargement 43 to get stuck in the discharging channel 84. The orifice of the discharging channel 84 is positioned near the ground so that the people can rest on the ground after being discharged.

The enlargements 43 have such a distance from each other along the rescue rope 7 (FIG. 14) that the people hanging on the enlargements 43 do not interfere with each other.

Figure 14:
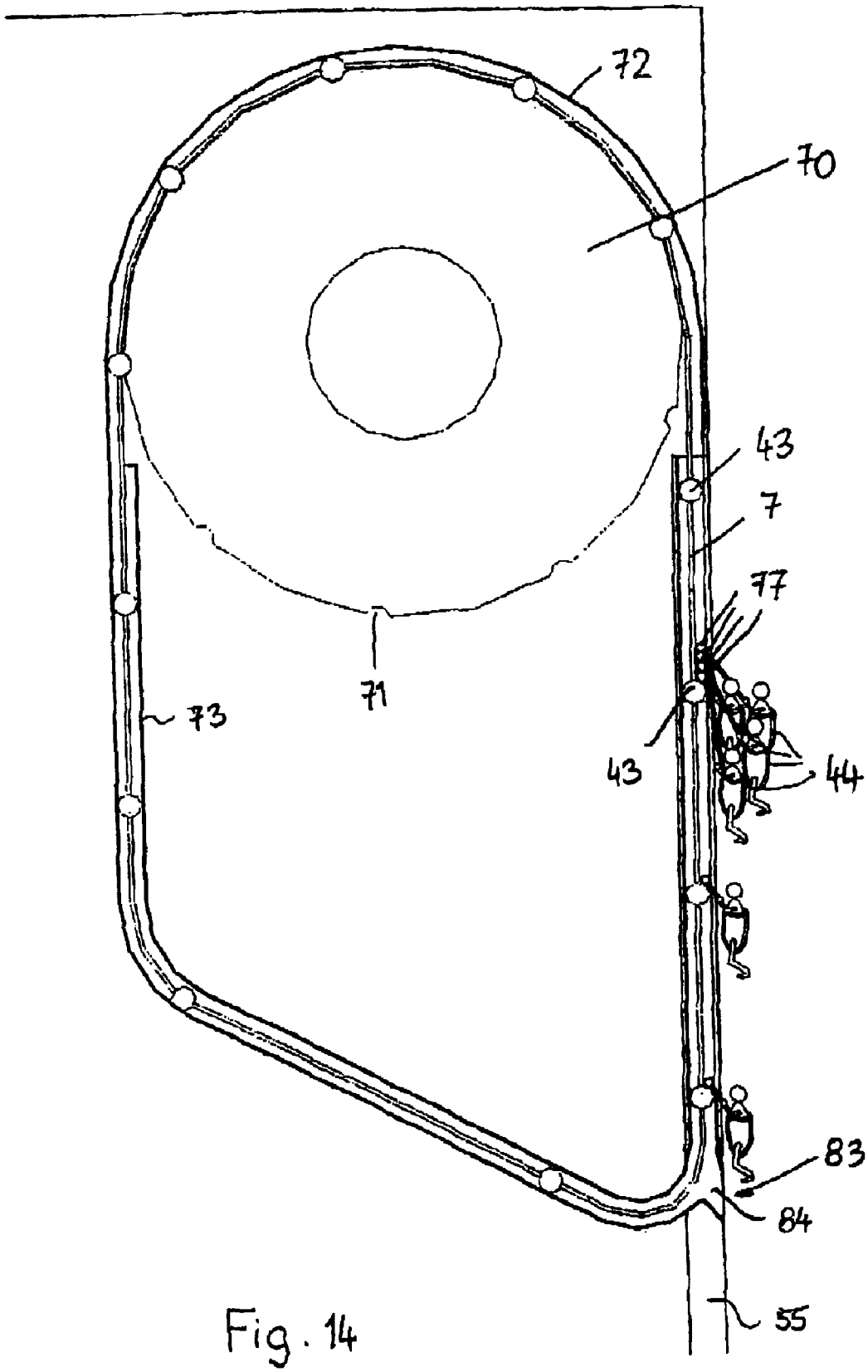

It is possible, as FIG. 14 shows, that several people are held at one enlargement 43 of the rescue rope 7. In this case, the retaining elements 77 of the rescue belts 44 rest directly on each other, whereas the lowest retaining element 77 rests on the enlargement 43.

The sheave 70 in the upper redirection area can be rotary driven so that the rescue rope 7 is circulating unendingly. It is also possible to form the rescue device in such a manner that the rescue rope 7 is displaced downwards under the weight of the people hanging on it.

The orifice of the discharging channel 84 does not have to be positioned at the ground area. It is offhand possible to position the discharging area 83 at the wall of the building, so that the people who are being discharged through the discharging area 83 get to for example a chute, on which they can slide downwards towards the ground.

What is claimed is:

1. A device for rescuing persons and objects from buildings, comprising:

at least one rescue element that is a rescue rope adapted to be anchored to the ground, wherein the rescue rope in an initial position is completely wound up and has a free end and wherein the rescue rope is unwound only in a rescue situation;

a retaining element of a rescue device configured to be attached to the rescue rope;

a deflection unit attached to the free end of the rescue rope;

power equipment for driving the rescue rope, wherein the deflection unit is connected to the power equipment when the rescue rope has been unwound.

2. The device according to claim 1, comprising a winding device, wherein the rescue rope in the initial position is wound onto the winding device.

3. The device according to claim 2, wherein the winding device has at least one winding element.

4. The device according to claim 3, wherein the winding element is a drum.

5. The device according to 1, wherein the rescue rope is an endless rope.

6. The device according to claim 1, wherein the deflection unit has an axis and wherein the rescue rope is redirected by 180° by the deflection unit.

7. The device according to claim 6, further comprising at least one driving gear fixedly attached to the axle of the deflection unit for common rotation.

8. The device according to claim 7, wherein the driving gear is coupled to at least one driving element of the power equipment.

9. The device according to claim 8, wherein the power equipment is positioned on the ground or mounted on a wall of the building.

10. The device according to claim 1, wherein the deflection unit has a tensioning device for the rescue rope.

11. The device according to claim 1, wherein the rescue rope is provided with stop elements, arranged along a complete length of the rescue rope, for interacting with the retaining element.

12. The device according to claim 11, wherein the stop elements are enlargements of the rescue rope.

13. The device according to claim 11, wherein the deflection unit has an axle provided with recesses to receive the stop elements of the rescue rope.

14. The device according to claim 13, comprising redirection/guide pulleys for the rescue rope.

15. The device according to claim 1, wherein the rescue rope is adapted to be positioned at windows of the building within reach for persons to be rescued.

16. The device according to claim 1, wherein the rescue rope is adapted to extend inside a housing wall of the building.

17. A device for rescuing persons and objects from buildings, comprising:

at least one rescue element that is an endless rescue rope;

a retaining element of a rescue device configured to be attached to the rescue rope;

a winding device, wherein the rescue rope in an initial position is completely wound up on the winding device and wherein the rescue rope is unwound from the winding device only in a rescue situation;

wherein the winding device has a driving shaft and a cross bar having a first end that is connected to the driving shaft so as to project radially from the driving shaft and having a second end, wherein an axle is connected to the second end of the crass bar;

wherein the endless rescue rope is looped about the driving shaft so that two strands of the rescue rope are formed;

wherein the axle, when the winding device is in operation, rotates around an axis of the driving shaft and entrains the two strands of the rescue rope.

18. The device according to claim 17, wherein the driving shaft provides a direction change for the rescue rope.

19. A device for rescuing persons and objects from buildings, comprising:

at least one rescue element that is an endless rescue rope adapted to be arranged in a housing wall adjacent to windows of the housing wall;

a retaining element of a rescue device configured to be attached to the rescue rope;

first and second guides adapted to be arranged in the housing wall for guiding two strands of the endless rescue rope, wherein the first guide is a pipe member and wherein the second guide is a channel comprising positioning units distributed over a length of the channel;

wherein the positioning units engage opposed sides of the rescue rope and are forced against the opposed sides by a spring force.

20. The device according to claim 19, wherein the positioning units have spring-loaded positioning jaws resting against opposite sides of the rescue rope.

21. A device for rescuing persons and objects from buildings, the device comprising:

at least one rescue element that is an endless rescue rope, wherein the rescue rope is configured to circulate in a plane extending transversely to an exterior of a building wall;

a guide adapted to be arranged in the building wall, wherein a first strand of the rescue rope is guided in the guide;

wherein the guide comprises inlet channels adapted to be arranged in window areas of the building wall, wherein the inlet channels are adapted to extend from an interior of the building through a window opening to the exterior, wherein the guide further comprises slantedly extending merging channels adapted to be arranged in the building wall and connecting the inlet channels to the guide, respectively;

wherein the inlet channels and the merging channels have a slot, respectively, configured to receive a rescue belt part having a retaining element for engaging the rescue rope;

wherein the guide has a discharging area in a lower deflection area of the rescue rope;

wherein the discharging area has a discharging channel adapted to extend at a slant to the exterior of the building wall.

22. The device according to claim 21, wherein the rescue rope is provided with stop elements, arranged along a complete length of the rescue rope, for interacting with the retaining element, wherein the stop elements are guiding elements.

23. The device according to claim 22, wherein the stop elements rest against an interior wall of the guide.

24. The device according to claim 21, wherein the retaining element is an enlargement at a free end of the (a) rescue belt part.

* * * * *